US007275269B2

(12) United States Patent
Skillman

(10) Patent No.: US 7,275,269 B2
(45) Date of Patent: Oct. 2, 2007

(54) WARMING SCARF

(76) Inventor: Heidi A. Skillman, 2143 Finley Rd. #616, Lombard, IL (US) 60148

( * ) Notice: Subject to any disclaimer, the term of this patent is extended or adjusted under 35 U.S.C. 154(b) by 105 days.

(21) Appl. No.: 10/684,640

(22) Filed: Oct. 14, 2003

(65) Prior Publication Data

US 2005/0076419 A1 Apr. 14, 2005

(51) Int. Cl.
*A42B 5/00* (2006.01)

(52) U.S. Cl. ..... 2/207; 2/468

(58) Field of Classification Search ..... 2/207, 2/916, 1, 468, 9, 131, 206
See application file for complete search history.

(56) References Cited

U.S. PATENT DOCUMENTS

| | | | | |
|---|---|---|---|---|
| 746,586 | A | 12/1903 | Schoch et al. | |
| 811,096 | A | 1/1906 | Scott | |
| 2,346,918 | A | 4/1944 | Herbranson | |
| 2,752,916 | A * | 7/1956 | Haliczer | 128/206.19 |
| 3,105,970 | A * | 10/1963 | Herzberg | 2/91 |
| 4,301,548 | A | 11/1981 | Blake | |
| 4,495,660 | A | 1/1985 | Hayden | |
| 4,654,897 | A | 4/1987 | Rosaen | |
| 4,718,123 | A | 1/1988 | Petropoulos | |
| 4,870,707 | A | 10/1989 | Hayes | |
| 5,025,508 | A | 6/1991 | Duncan | |
| 5,058,211 | A | 10/1991 | Hanks | |
| 5,414,869 | A * | 5/1995 | Thomson | 2/207 |
| D368,571 | S | 4/1996 | Worku | |
| 5,720,049 | A | 2/1998 | Clutton | |
| 5,720,052 | A * | 2/1998 | Walker | 2/468 |
| D398,136 | S | 9/1998 | Samelian | |
| 5,802,618 | A | 9/1998 | Mustata | |
| 6,032,292 | A | 3/2000 | Wood et al. | |
| 6,226,799 | B1 | 5/2001 | Lane | |
| 6,282,722 | B1 | 9/2001 | Pogachar | |

OTHER PUBLICATIONS

Joseph-Armstrong, Helen. "Patternmaking for Fashion Desing" Third Edition. Prentice Hall, pp. 217,226-27.*
Tortora, Phyllis and Robert Merkel. "Fairchild's Dictionary of Textiles" Seventh Edition. Fairchild Publication, pp. 111 and 430.*
Aerostitch Riderware Online Catalog; Nos. 511-515 and 550-552 internet store ad.
353 POV Design Studio Bandanna (901) internet store ad.
Thermo-Cool Bandana 04705 internet store ad.
Sno-ski.com Seirus Neofleece face and neck warmer Item #1-SNCS internet store ad.
Suzknits Neck Warmer internet store ad.
Harper products Buffalo windstop neck warmer internet store ad.
The Vermont Country Store Mini Neck Warmer No. 36801 internet store ad.

* cited by examiner

*Primary Examiner*—Katherine Moran
*Assistant Examiner*—Richale L. Haney
(74) *Attorney, Agent, or Firm*—Jerry A. Schulman

(57) ABSTRACT

A warming scarf has front and rear panels assembled to create an insulating air pocket when the scarf is worn. The front panel is larger than the rear panel and the excess fabric is gathered and pleated at the scarf's edges to "pouch" the fabric and form the air pocket.

32 Claims, 10 Drawing Sheets

WARMING SCARF

BACKGROUND OF THE INVENTION

This invention relates generally to articles of clothing and, more particularly, to a warming scarf which forms a series of insulating pockets when secured snugly about a user's neck.

Traditional warming scarves are tied or wrapped around the neck, creating excess tails or a bulky tie section. Many such scarves leave some of the neck exposed to the air and must be continually readjusted, particularly if the wearer moves.

Attempts have been made to provide more efficient scarves. Some, formed as combination neck, face and/or chest warmers are tubes of material that must be pulled over the head. Others are combination face and neck warmers having a face portion which must be pulled down if the wearer only desires to cover the neck. The fabric that would cover the face is as bunched around the neck creating a bulky feel and appearance and acts as a trap for condensation which causes discomfort for the wearer. Examples of such scarves are well represented in both the patented and unpatented prior art.

U.S. Pat. No. 6,032,292 (Wood et al) teaches and describes a triangular convertible scarf having an adjusting cord which can cause the scarf material to bunch up around the neck when the cord is tightened. Insulation is provided by a plurality of individual thermal layers stitched and secured between the inner and outer layers of the bandanna.

U.S. Pat. No. 746,586 (Schoch et al) teaches and describes a combination muffler and chest protector having a collar or mock turtle neck attached to a back and a pair of front straps which criss-cross over the chest and are secured to the back.

U.S. Pat. No. 811,096 (Scott) teaches and describes a neck muffler combining a neck and chest portion with the neck portion secured behind the neck by snaps or the like to prevent wrinkles or creases.

U.S. Pat. No. 2,346,918 (Herbranson) teaches and describes a scarf formed to drape around the neck or shoulders secured by a zipper extending from mid chest up toward the chin.

U.S. Pat. No. 4,301,548 (Blake) teaches and describes an ascot-like garment having a neck portion attached to a chest portion with the neck portion fastenable at the rear of the neck.

U.S. Pat. No. 4,495,660 (Hayden) teaches and describes a neck garment attachable as a wrap around the neck formed as a single knit layer with a muffler portion which covers the neck and a depending skirt which covers the shoulders and a portion of the chest. The skirt has pleats formed at the lowermost edge to act as a seal.

U.S. Pat. No. 4,654,897 (Rosaen) teaches and describes a tail-less neck scarf having a single homogenous layer attachable around the wearer's neck with a hook and loop type fastener to accommodate a range of neck sizes.

U.S. Pat. No. 4,718,123 (Petropoulous) teaches and describes a cold climate protective garment formed as a homogenous layer and having an upper portion adapted to cover the mouth and nose and the lower portion adapted to cover a portion of the chest and secured by a pair of straps which use hook and loop type fasteners attachable behind the neck.

U.S. Pat. No. 4,870,707 (Hayes) teaches and describes a multiple purpose scarf formed from two mirror image single layer triangular panels joined at a connecting neck. A number of these panels can be combined to drape the scarf around the neck or shoulders in varying configurations to form different types of garments, some of which form draped, single-layer folds or decorative pleats.

U.S. Pat. No. 5,025,508 (Duncan) teaches and describes a scarf construction formed from triangular layers, some of which are sewn together or attached together offset from one another and one of which is formed from two congruent triangular layers forming a pocket within which an inflatable bladder is placed to retain the geometric integrity of the scarf in its triangular shape.

U.S. Pat. No. 5,058,211 (Hanks) teaches and describes a bandanna-type article of wearing apparel having a generally triangular central section to which a pair of tying ears extend. The scarf is worn by knotting the ties behind the head. The portion of the scarf intended to cover the mouth can also include an insulating layer such as a polyurethane sponge.

U.S. Pat. No. 5,720,049 (Clutton) teaches and describes a scarf formed as a hollow symmetrical sleeve tapered at both ends. The tapers form folds or gathers for the purpose of attaching weighted attachment hooks.

U.S. Pat. No. 5,802,618 (Mustata) teaches and describes a neck and chest scarf formed of symmetrical pieces sewn together and then turned inside out to form a generally T-shape scarf having a portion that can be fit around the mouth and nose of the wearer or which may be folded down to cover only the neck of the wearer and a lower portion which covers the chest area.

U.S. Pat. No. 6,226,799 (Lane) teaches and describes a scarf having upper and lower horizontally extending sections with a back portion depending from the lower section. Each of the upper and lower sections can be wrapped and secured around the neck. This overlapping one another positioning the back portion to depend along the wearer's back.

U.S. Pat. No. 6,282,722 (Pogachar) teaches and describes a protective leather, or like material, face and neck bandanna with interchangeable, two-ply flannel, or like material liner attached with snap pressure closures. An outer, leather triangular bandanna has a liner and an intervening insulating layer attachable so that the inner layers can be detached and cleaned without damage to the leather.

U.S. Pat. No. Des. 368,571 (Worku) teaches and describes an ornamental design for a scarf having what appears to be an asymmetrical one layer unpleated construction.

U.S. Pat. No. Des 398,136 (Samelian) teaches and describes a neck warmer formed as a single rectangular layer with a pocket formed in the front to fit over the nose and mouth of the wearer.

BRIEF DESCRIPTION OF THE INVENTION

The foregoing references generally teach the use of symmetrical fabric forms fashioned into scarves or other warming clothing. Those that include additional provisions for increasing the warming capability of the scarf construction do so by adding warming fabrics or inserts as part of the original construction or teach the provision of additional layers by folding down a portion of the scarf, particularly around the neck. None teach, describe nor suggest the provision of additional warming capability provided by the combination of the scarf design and the donning of the scarf, allowing it to drape around the wearer's neck and shoulders to form additional insulating air pockets.

Accordingly, the need exists for a warming scarf that is simple and lightweight in construction and securely covers the neck and a portion of the chest area of a wearer.

One object of the present invention is to provide such scarves in constructions and sizes which increase the warming capacity of the scarf as it is put on without requiring the addition of insulating layers or bladders.

A further object of the present invention is to provide such scarves in forms which are easy to launder and maintain and which are reversible and which allow for the use of decorative fabric without sacrificing warmth.

Yet another object of the present invention is to provide such scarves that can be fashioned efficiently from cloth minimizing scrap and wasted fabric during the cutting process.

I have invented an article of clothing specifically designed to keep a person's neck and chest warm which is constructed to cover several ranges of neck sizes, is easily put on and taken off, does not require tying to secure it, has no excess bulky material, can be comfortably worn underneath a coat or jacket and which, by its construction, provides increased warmth beyond that to be expected by the materials used to make the scarf.

BRIEF DESCRIPTION OF THE DRAWINGS

These and further objects of the present invention will be best appreciated by considering the accompanying drawing figures in which.

While the following describes a preferred embodiment or embodiments of the present invention, it is to be understood that this description is made by way of example only and is not intended to limit the scope of the present invention. It is expected that alterations and further modifications, as well as other and further applications of the principles of the present invention will occur to others skilled in the art to which the invention relates and, while differing from the foregoing, remain within the spirit and scope of the invention as herein described and claimed. Where means-plus-function clauses are used in the claims such language is intended to cover the structures described herein as performing the recited functions and not only structural equivalents but equivalent structures as well. For the purposes of the present disclosure, two structures that perform the same function within an environment described above may be equivalent structures.

DETAILED DESCRIPTION OF THE DRAWINGS

Figure 1:
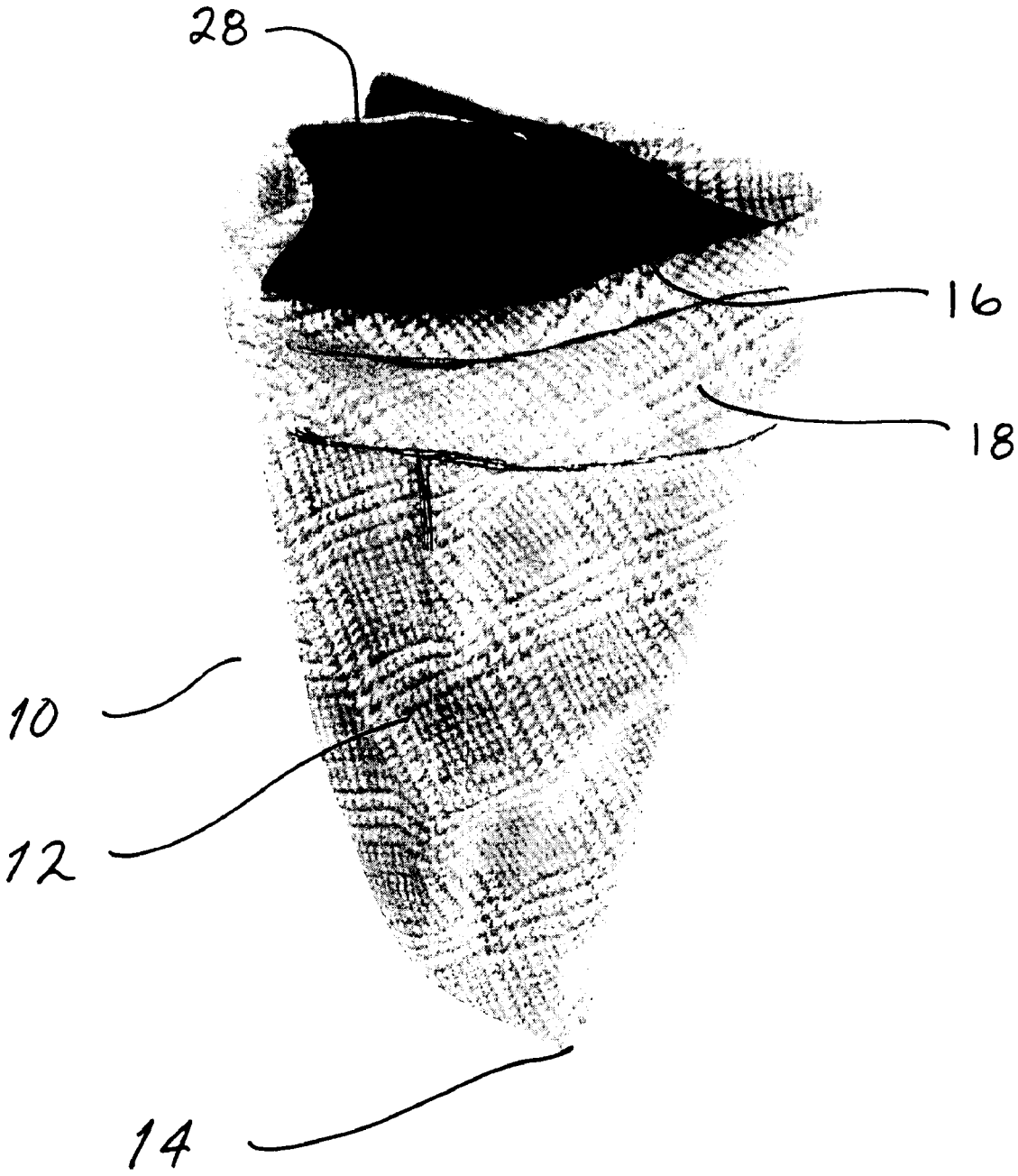
FIG. 1 is a front view of a preferred embodiment of the present invention showing the scarf closed.

Referring now to FIG. 1 the numeral 10 identifies generally a warming scarf constructed in accordance with a preferred embodiment of the present invention. Scarf 10 is shown in FIGS. 1, 2 and 3 as sewn from its component parts and as assembled to fit around the neck of a wearer.

Figure 8:
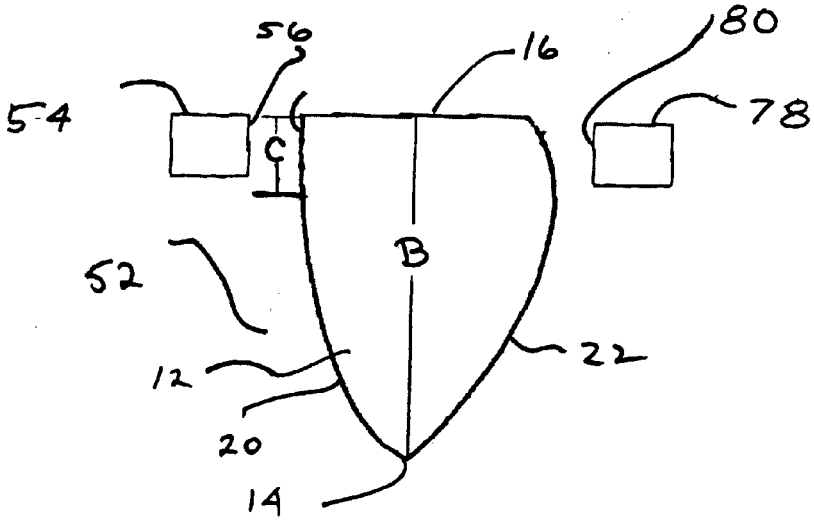
FIG. 8 is a schematic drawing showing the cloth blank for the front side of the scarf.

As seen in FIGS. 1 and 8, scarf 10 has a front side 12 which is formed generally as an inverted triangle in shape with a front scarf tip 14 being the vertex of the triangle and with a scarf front top 16 being the triangle base. A series of folds 18 are formed at and extend generally parallel to top 16 in a manner to be described herein.

Figure 2:
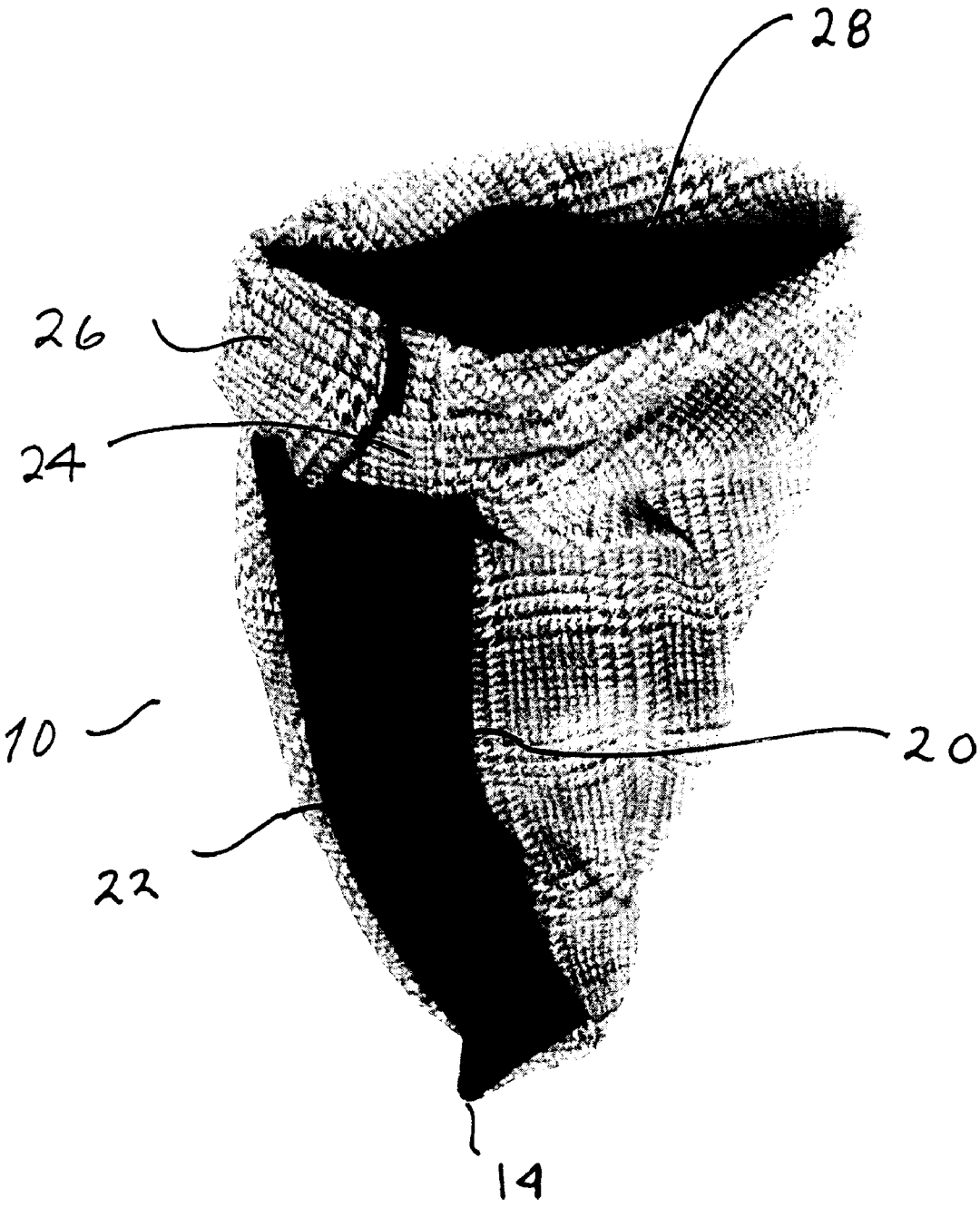
FIG. 2 is a side view of the scarf shown in FIG. 1.
Figure 3:
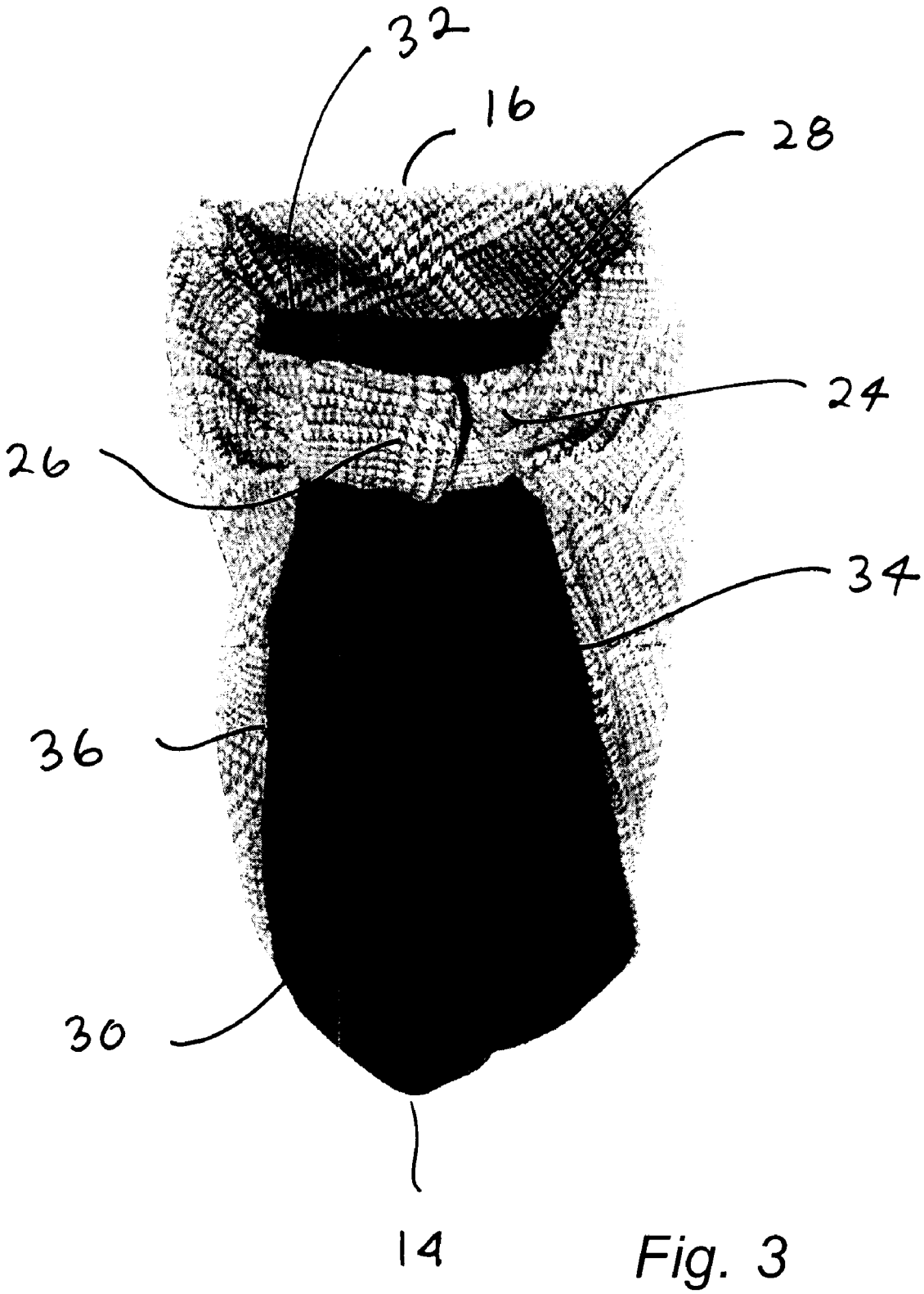
FIG. 3 is a rear view of the scarf shown in FIG. 1.

As seen in FIGS. 2 and 8, scarf front 12 has a left edge 20 and a right edge 22 corresponding generally to the sides of the inverted triangular shape.

Figure 4:
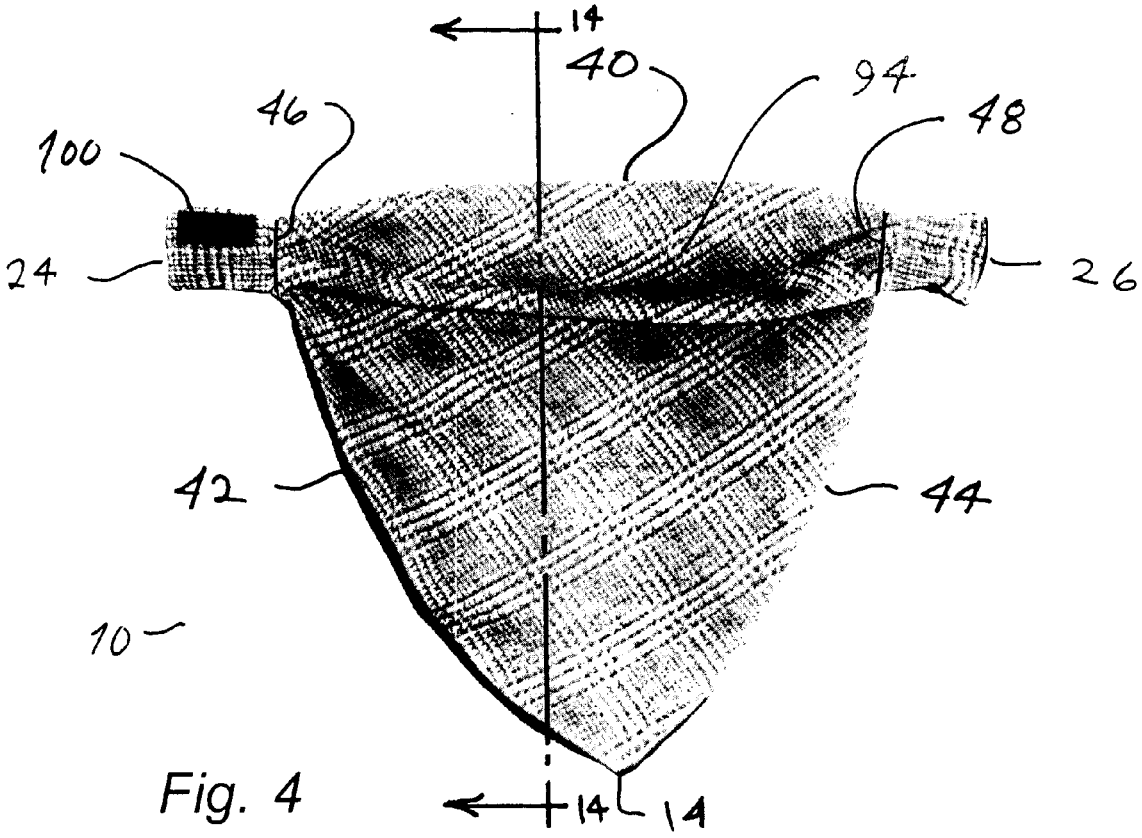
FIG. 4 is a front view of the scarf of FIG. 1 shown lying open and flat.

Referring now to FIG. 4, a front view of scarf 10 is shown as it appears "open", meaning spread out prior to being donned by a wearer. Left and right closure tabs 24, 26 are shown, with tab 24 seamed to scarf 10 at a seam 46 and tab 26 seamed to scarf 10 at a seam 48.

Figure 5:
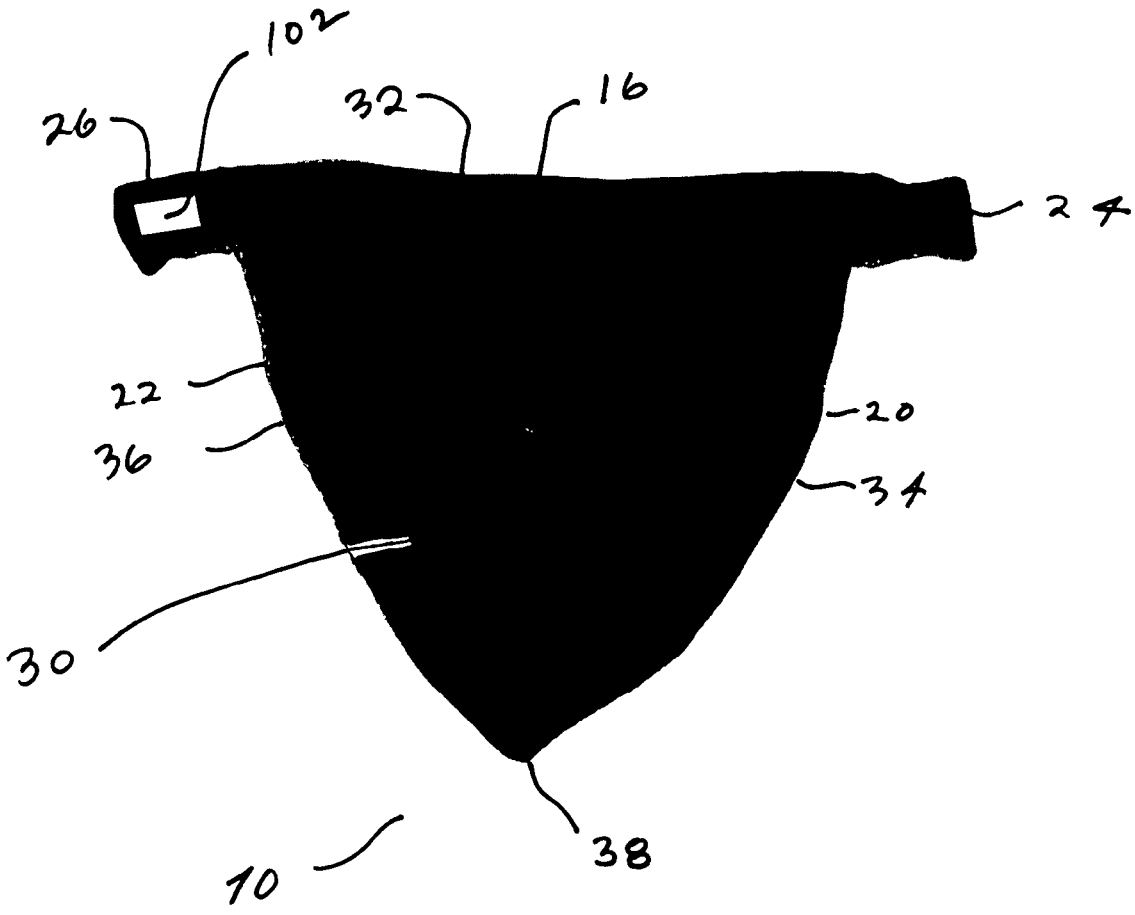
FIG. 5 is a rear view of the scarf as shown in FIG. 4.
Figure 7:
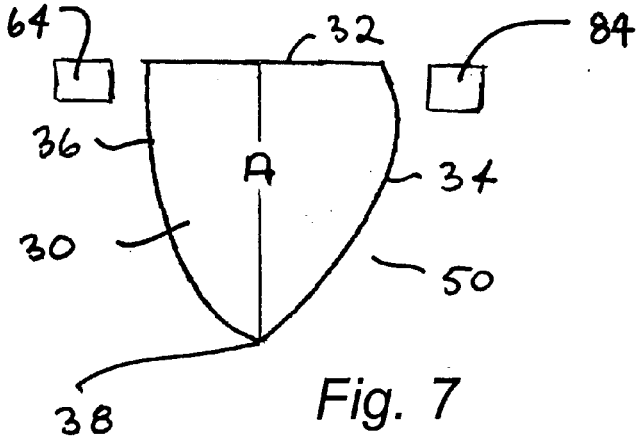
FIG. 7 is a schematic drawing showing the cloth blank for the rear side of the scarf.

Referring to FIG. 5, a rear side 30 of scarf 10 is shown as the reverse view of that in FIG. 4. As seen in FIGS. 5 and 7, a rear panel 50 has a generally triangular rear side 30 with a rear top edge 32, a rear left edge 34, a rear right edge 36 and a rear tip 38.

Figure 6:
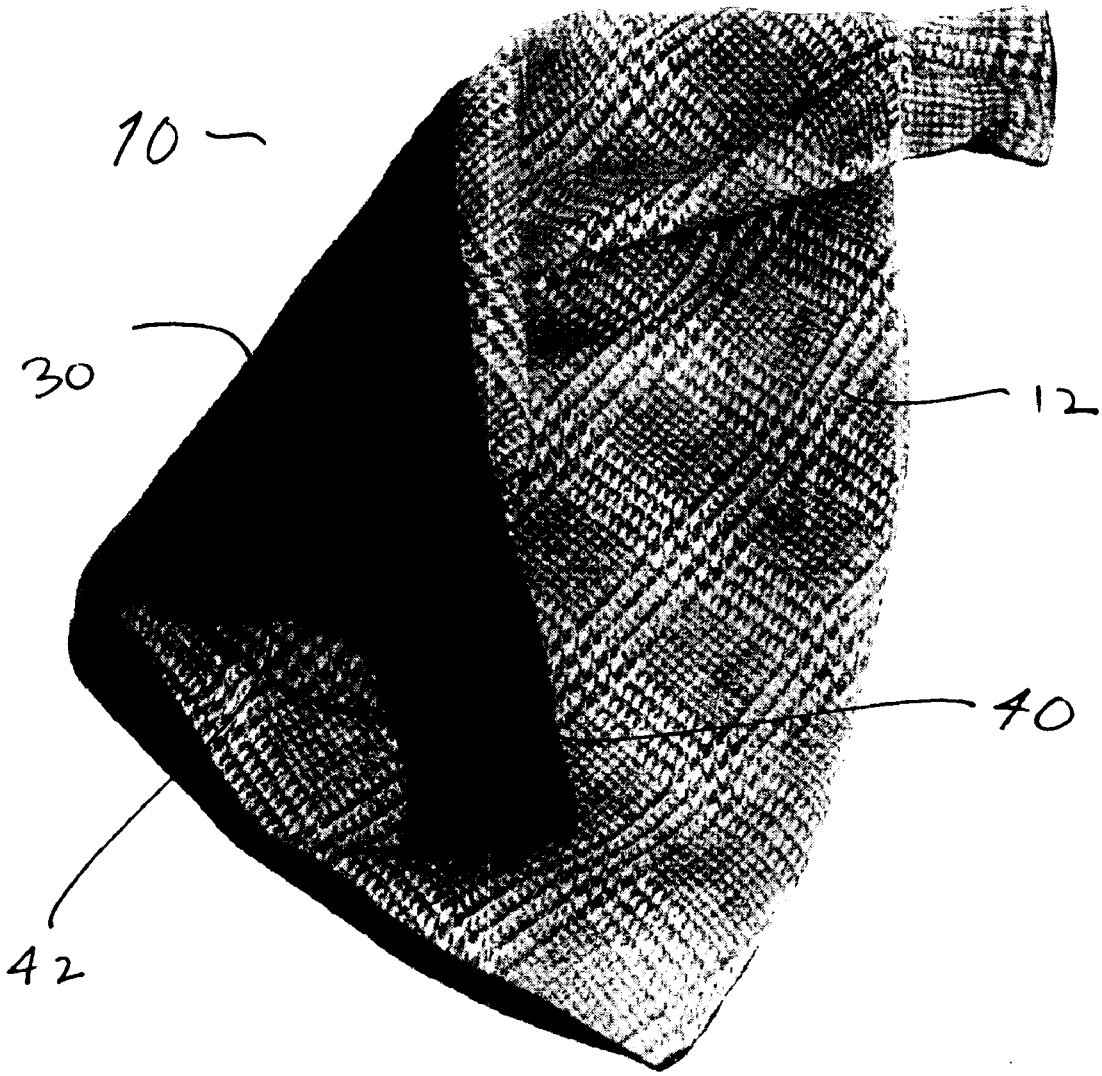
FIG. 6 is a front view of the scarf of FIG. 1 with one side turned over to show the back or fleece side.

As seen in FIG. 5 when scarf 10 is seamed together top edges 16 and 32 are seamed one to another to form a top seam 40, left edges 20 and 34 are seamed together to form a left seam 42 and right edges 22, 36 are seamed together to form a right seam 44. This seaming can also be seen in FIG. 6, where a portion of top seam 40 is shown, as is a portion of right seam 42.

As best seen in FIG. 3, when scarf 10 is assembled, closure tabs 24, 26 overlap and are attachable one to the other. A preferred method of attachment is by the use of hook-and-loop fastener elements such as those commonly referred to as "velcro"®, with a first fastener element 100 sewn to the front of tab 24 and, as seen in FIG. 5, a second, mating fastener element 102 sewn to the rear side of tab 26. When attached, top edge 16 and tabs 24, 26 form a neck opening 28. Scarf 10 is intended to be secured around the neck of a wearer by passing tabs 24, 26 from the front of the user's neck around both sides to be attached one to the other at the nape of the neck.

As seen in FIGS. 7 and 8, rear panel 50 has a base-to-vertex dimension A, while front panel 52 has a base-to-vertex dimension B. It is a feature of the present invention that dimension B is greater than dimension A by a distance C making panel 52 longitudinally longer than panel 50. That portion of panel 52 extending downward the distance C from top edge 16 will be referred to as the "gather strip".

Figure 9:
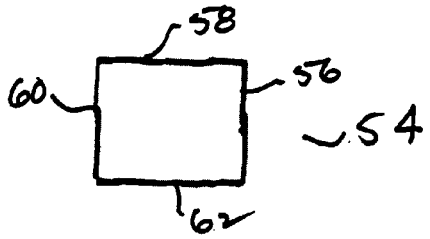
FIG. 9 is a front panel of a closure tab.
Figure 10:
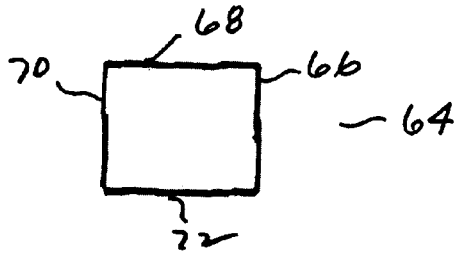
FIG. 10 is a rear panel of a closure tab.

Referring to FIG. 9, a closure tab front panel 54 is shown, having a seam edge 56 and free edges 58, 60 and 62. In FIG. 10, a closure tab rear panel 64 is shown, having a seam edge 66 and free edges 68, 70 and 72. For purposes of illustrating the invention, panels 54 and 64 form closure tab 24, while similar panels are assembled to form closure tab 26 as described below.

Figure 12:
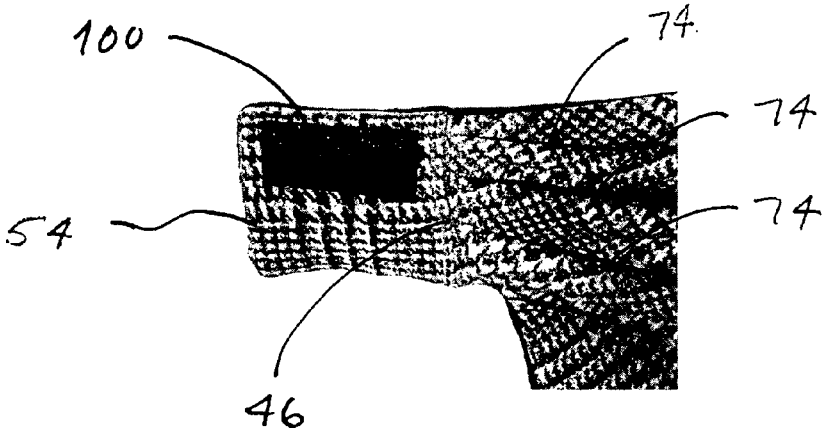
FIG. 12 is an enlarged detail of the scarf bunched seam segment.
Figure 11:
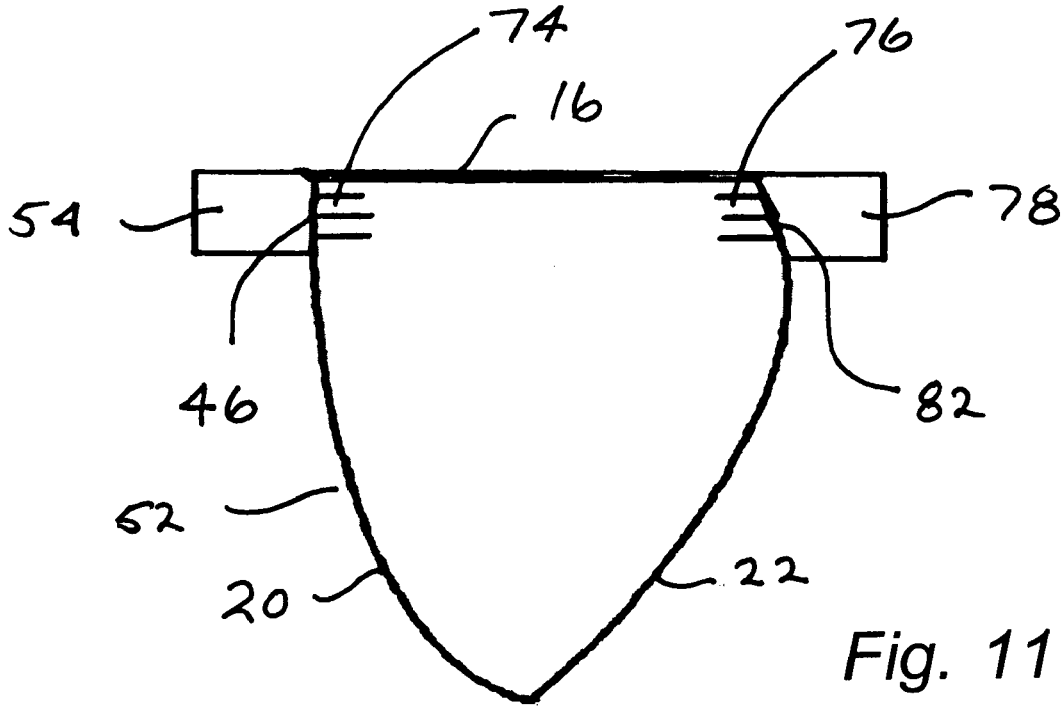
FIG. 11 is the cloth blank of FIG. 8 with the closure tabs attached.

It is a further feature of the invention that when the front panel is bunched to create the gather strip, sufficient material is taken up to give the edge of panel 52 an effective size and shape congruent to that of the edge of panel 50. Referring again to FIG. 8, the gather strip portion of panel 52 is shown "bunched" at 74 along edge 20 proximate top edge 16 (also shown in FIGS. 11 and 12). After being formed, bunch 74 is basted to keep its shape. Bunch 74 is permanently held in place by seaming closure tab front panel 54 to panel 52 along seam edge 56, thereby forming a first bunch seam 46. In like fashion, a second bunch 76 is formed along edge 22 proximate top edge 16 and is basted and then secured in place by a second closure tab front panel 78 having a seam edge 80 which is sewn to edge 22 of panel 52 forming a second bunch seam 82. This is seen in greater detail in FIG. 12 where tab 54 is shown seamed to panel 52 forming bunch 74.

Figure 13:
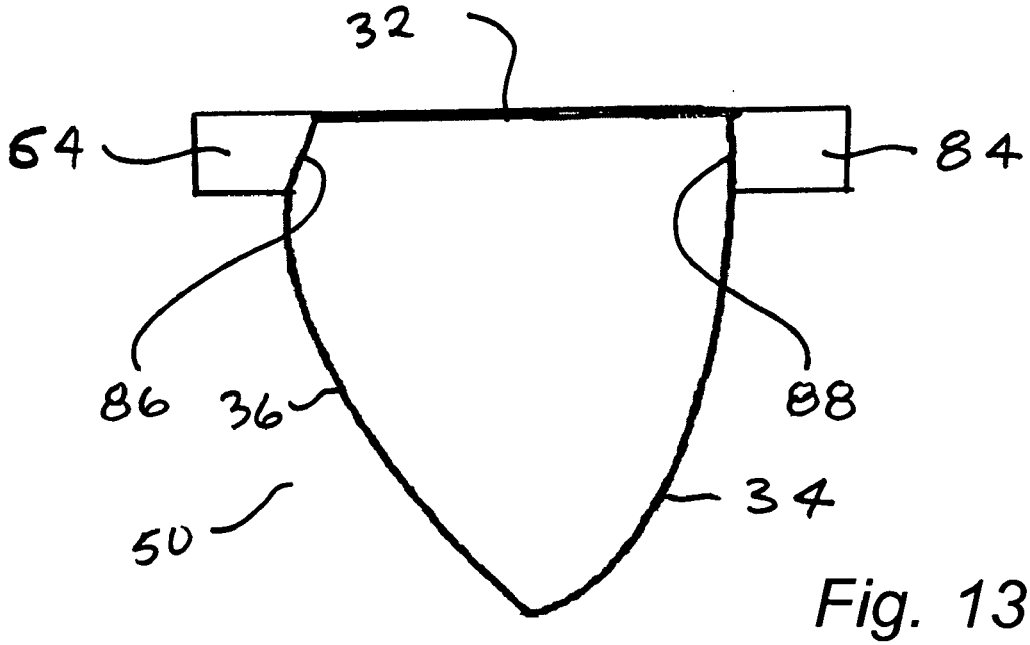
FIG. 13 is the cloth blank of FIG. 7 with the closure tabs attached.

Referring now to FIG. 13, rear panel 50 is shown with closure tab rear panel 64 seamed to edge 36 proximate top edge 32 and a second closure tab rear panel 84 seamed to edge 34 proximate top edge 32 forming first and second rear tab seams 86, 88, respectively.

Panels 50, 52 are now attached to each other in the following manner. In FIG. 7, numeral 30 indicates the outer face of panel 50 while in FIG. 8 the numeral 12 indicates the front or outer face of panel 52. The front face of panel 50 is placed against the front face of panel 52 with edge 22 aligned with edge 36, edge 20 aligned with edge 34, tab 54 overlapping and aligned with tab 84 and tab 78 overlapping and aligned with tab 64. Panels 50, 52 are then sewn together to form seams 40, 42 and 44 as seen in FIG. 4. In similar fashion, the peripheries of aligned tabs 64, 78 are stitched together as are edges 20 and 36. The stitching preferably is interrupted at one of the tabs 24 or 26. The resulting gap allows scarf 10 to be turned inside out, thereby exposing the outer faces of panels 50, 52, while presenting a neat finished appearance for the seams sewn around the outer periphery of scarf 10. Once scarf 10 has been turned inside out, the remaining periphery of tab 24 or 26 is stitched to complete the construction.

Figure 14:
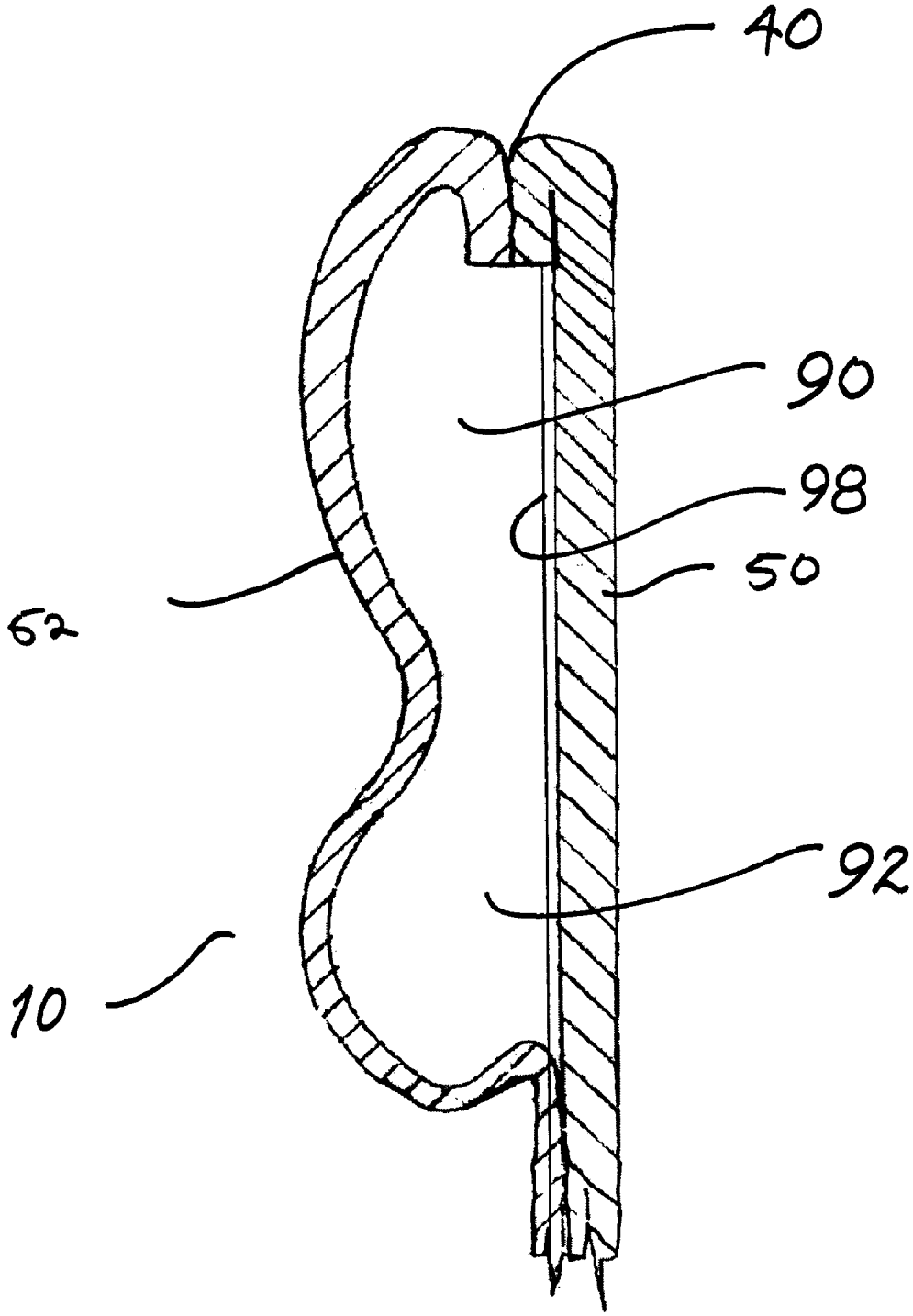
FIG. 14 is a partial side sectional view of the assembled scarf.

Referring now to FIG. 14, a partial sectional view taken generally along lines 14-14 of FIG. 4, can be seen that the excess material of panel 52 bulges outward to form a series of contiguous air pockets 90, 92 defined between panels 50, 52.

Figure 15:
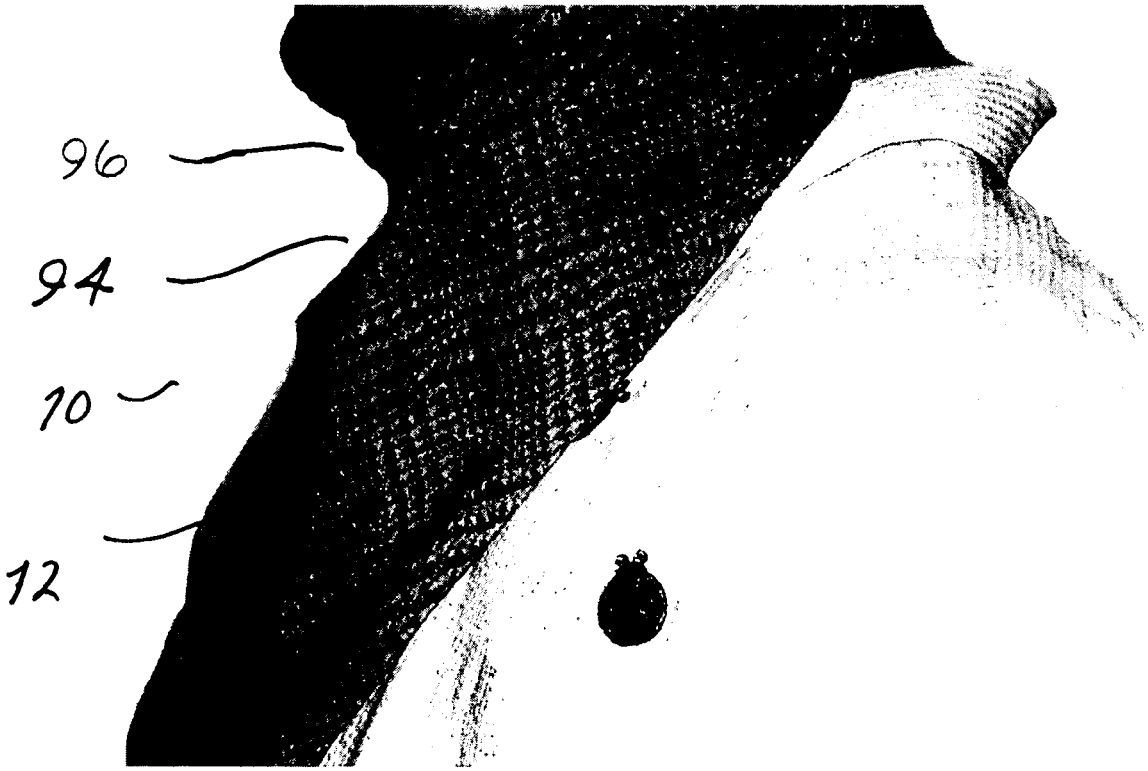
FIG. 15 is a left side view of a person wearing the scarf.

Bunches 74 and 76 thus create a hollow, "ballooned-out" scarf band 94 shown in FIG. 4 defining air pockets 90, 92 between panels 50, 52 and extending generally from tab 24 to tab 26. When a wearer positions scarf 10 about his or her neck as shown in FIG. 15, scarf band 94 forms a series of neck folds 96 within which air is trapped, creating an insulating effect that enhances the warmth of scarf 10 beyond that which would be achieved if panels 50, 52 were simply made to identical shapes and sizes and seamed together.

The exact configuration of air pockets 90,92 and, thereby, folds 96 will vary with the wearer's neck size and the manner in which the wearer drapes or secures scarf 10 about the neck.

Preferably, dimension A is about 16 inches, while dimension B is about 18.5 inches, making dimension C about 2.5 inches. These dimensions will of course vary with the overall size of the scarf, with the dimension C being sufficient to create folds 68 when scarf 10 is worn.

Rear panel 50 and front panel 52 can be formed from different materials making attractive combinations of texture, color and function. For example, front panel 52 can be formed from silk or wool in a wide variety of colors and patterns while rear panel 50 can be formed from material such as fleece which feels particularly comfortable against the bare skin of the neck. It has also been noted that scarf 10 exhibits the same increased feeling of warmth over prior art scarves when it is reversed and front side 12 is worn against the skin while rear side 30 is exposed. Using different materials or patterns for front and rear panels 52, 50 allows the wearer to choose between two different appearances for scarf 10 depending upon which side is exposed and which is placed against the neck. Similarly, closure tab front panels 54 are preferably made from fabric matching that of panel 52 while closure tab rear panels 64 are preferably made from fabric which matches rear panels 50.

As seen in FIG. 14, an additional thin layer of fabric 98, such as silk, can be seamed to the interior of fleece rear panel 50, enhancing the warming properties of the fleece by adding an additional thin layer of fabric.

When not in use scarf 10 can be folded to fit into a coat pocket, purse or other relatively small space. This is due in part to its simplified construction, using relatively thin layers of material rather than the bulkier materials or thick insulating layers or materials shown in the prior art discussed above, and using simple closures such as the tabs described above.

I claim:

1. A scarf, said scarf comprising:

a first panel having a top edge, a first peripheral edge extending from one end of said first panel top edge to the other end of said first panel top edge, a second panel having a top edge, a second peripheral edge extending from one end of said second panel top edge to the other end of said second panel top edge;

said first and second top panel edges being about the same length;

said first peripheral edge being longer than said second peripheral edge whereby said first panel is larger than said second panel;

at least one portion of said first peripheral edge bunched to form a gathered strip sufficient in length to allow said first and second peripheral edges substantially to coincide;

said first and second peripheral edges attached to form a peripheral seam; and said first panel top edge attached to said second panel top edge to form atop seam, whereby said first and second panels, said top seam and said peripheral seam define an air chamber between said panels.

2. The apparatus as recited in claim 1 wherein said scarf further includes means for securing said scarf around the neck of a wearer.

3. The apparatus as recited in claim 2 wherein securing means comprises first and second tabs attached to said scarf opposite one another and proximate said top seam.

4. The apparatus as recited in claim 1 wherein said at least one said gathered strip is positioned proximate said top seam.

5. The apparatus as recited in claim 1 wherein said first and second panels are generally triangular in shape with said first peripheral edge forming two sides of said first panel and said second peripheral edge forming two sides of said second triangular panel.

6. The apparatus as recited in claim 1 wherein the peripheral edges of said first and second panels are substantially congruent after at least one said gathered strip is formed on said first peripheral edge.

7. The apparatus as recited in claim 1 wherein said top seam and peripheral seam are formed by stitching.

8. The apparatus as recited in claim 1 wherein at least one of said first and second panels further comprises a third panel attached to and generally coextensive with said one of said first and second panels.

9. The apparatus as recited in claim 8 wherein said first panel is formed from fabric.

10. The apparatus as recited in claim 8 wherein said second panel is formed from fleece fabric.

11. The apparatus as recited in claim 8 wherein said third panel is formed from fabric.

12. The apparatus as recited in claim 11 wherein said fabric is silk.

13. A scarf, said scarf comprising:

a first generally triangular panel having a base edge having first and second ends, and an apex opposite said base, a first peripheral edge extending from said first panel first base end to said apex, and a second peripheral edge extending from said first panel second base end to said first panel apex, a second generally triangular panel having a base edge having first and second ends, and an apex, a third peripheral edge extending from said second panel first base end to said second panel apex, and a fourth peripheral edge extending from said second panel second base end to said second panel, said first and second peripheral edges being longer than said third and fourth peripheral edges;

at least one portion of said first edge and at least one portion of said second peripheral edge is bunched to form a gathered strip, said gathered strip formed proximate said first panel base edge and of sufficient length to allow said first and second peripheral edges substantially to coincide with said third and fourth peripheral edges;

said first panel base edge attached to said second panel base edge to form a top seam, said first panel first and second peripheral edges attached to said second panel third and fourth peripheral edges to form a peripheral seam, whereby said gathered strips, said top seam, said peripheral seam and said first and second panels define an air chamber between said panels.

14. The apparatus as recited in claim 13 wherein said scarf further includes means for securing said scarf around the neck of a wearer.

15. The apparatus as recited in claim 14 wherein securing means comprises first and second tabs attached to said scarf opposite one another and proximate said top seam.

16. The apparatus as recited in claim 13 wherein said said gathered strips are positioned proximate said top seam.

17. The apparatus as recited in claim 13 wherein the peripheral edges of said first and second panels are substantially congruent after said gathered strips are formed on said first panel peripheral edges.

18. The apparatus as recited in claim 13 wherein said top seam and said peripheral scarf are formed by stitching.

19. The apparatus as recited in claim 13 wherein at least one of said first and second panels further comprises a third panel attached to and generally coextensive with said one of said first and second panels.

20. The apparatus as recited in claim 13 wherein said first panel is formed from fabric.

21. The apparatus as recited in claim 20 wherein said third panel is formed from fabric.

22. The apparatus as recited in claim 13 wherein said second panel is formed from fleece fabric.

23. The apparatus as recited in claim 20 wherein said fabric is silk.

24. A scarf, said scarf comprising:

a substantially triangular front panel having a top edge, and left and right side edges, said left and right front panel side edges meeting at a front panel apex distal from said front panel top edge, said left and right side edges forming a front peripheral edge;

a substantially triangular rear panel having a top edge, and left and right side edges, said left and right rear panel side edges meeting at a front panel apex distal from said rear panel top edge, said left and right side edges forming a rear peripheral edge;

said front peripheral edge being longer than said rear peripheral edge;

at least one portion of said front peripheral edge bunched to form a gathered strip sufficient in length to allow said front and rear peripheral edges substantially to coincide;

said scarf formed by attaching said front and rear panels together by seaming together said front and rear top edges to form a top scarf seam and by seaming said front and rear peripheral edges together to form a peripheral scarf seam that includes said gathered strips of said front peripheral edge, said front and rear panels, said top scarf seam and said peripheral scarf seam defining an air chamber between said panels.

25. The apparatus as recited in claim 24 wherein said scarf further includes means for securing said scarf around the neck of a wearer.

26. The apparatus as recited in claim 25 wherein said securing means comprises left and right front closure tabs, said left front closure tab sewn to said front panel at said left front side edge, said right front closure tab sewn to said front piece at said right front side edge;

said right back closure tab sewn to said right rear side edge at said rear side piece top edge, and said left back closure tab sewn to said left rear side edge at said rear side piece top edge, said right front and right rear closure tabs seamed together to form a right scarf tab, and said left front and left rear closure tabs stained together to form a left scarf tab.

27. The apparatus as recited in claim 24 wherein the peripheral edges of said front and rear panels are substantially congruent after said gathered strip are formed on said front panel peripheral edge.

28. The apparatus as recited in claim 24 wherein at least one of said front and rear panels further comprises a third panel attached to and generally coextensive with said one of said first and second panels.

29. The apparatus as recited in claim 28 wherein said front panel is formed from fabric.

30. The apparatus as recited in claim 28 wherein said rear panel is formed from fleece fabric.

31. The apparatus as recited in claim 28 wherein said third panel is formed from fabric.

32. The apparatus as recited in claim 31 wherein said fabric is silk.

* * * * *